US006674035B2

(12) United States Patent
Ito

(10) Patent No.: US 6,674,035 B2
(45) Date of Patent: Jan. 6, 2004

(54) PAPER DISCHARGE DEVICE

(75) Inventor: Akihiko Ito, Chiba (JP)

(73) Assignee: Seiko Instruments Inc., Chiba (JP)

( * ) Notice: Subject to any disclaimer, the term of this patent is extended or adjusted under 35 U.S.C. 154(b) by 45 days.

(21) Appl. No.: 09/808,073

(22) Filed: Mar. 14, 2001

(65) Prior Publication Data

US 2001/0022427 A1 Sep. 20, 2001

(30) Foreign Application Priority Data

Mar. 17, 2000 (JP) ..... 2000-075762

(51) Int. Cl.[7] ..... B07C 5/00

(52) U.S. Cl. ..... 209/563; 209/583; 271/314; 271/185; 271/21

(58) Field of Search ..... 271/314, 184, 271/185, 186, 21

(56) References Cited

U.S. PATENT DOCUMENTS

| | | | | | |
|---|---|---|---|---|---|
| 4,262,895 | A | * | 4/1981 | Wenthe, Jr. | 271/184 |
| 4,579,228 | A | * | 4/1986 | Case | 209/563 |
| 4,673,176 | A | * | 6/1987 | Schenk | 271/186 |
| 5,201,517 | A | * | 4/1993 | Stemmle | 270/58.07 |
| 5,317,377 | A | * | 5/1994 | Rubscha et al. | 271/186 |
| 5,449,164 | A | | 9/1995 | Quesnel et al. | 271/186 |
| 5,887,868 | A | | 3/1999 | Lambert et al. | 271/186 |
| 6,070,869 | A | * | 6/2000 | Kim | 271/185 |
| 6,371,481 | B1 | * | 4/2002 | Miyake | 271/185 |
| 6,446,956 | B1 | * | 9/2002 | Sato et al. | 271/176 |

FOREIGN PATENT DOCUMENTS

| | | |
|---|---|---|
| EP | 0211462 | 2/1987 |
| EP | 0659668 | 6/1995 |
| JP | 60236965 | 11/1985 |
| WO | 00061483 | 10/2000 |

OTHER PUBLICATIONS

Patent Abstracts of Japan, vol. 009, No. 172 (M–397), Jul. 17, 1985,publication No. 60044459, publication date Mar. 9, 1985.

* cited by examiner

*Primary Examiner*—Donald P. Walsh
*Assistant Examiner*—Jonathan R Miller
(74) *Attorney, Agent, or Firm*—Adams & Wilks

(57) ABSTRACT

A paper discharge device has a first conveyance path having an input port through which paper is introduced, a second conveyance path having a discharge port through which the paper is discharged, and a third conveyance path. A paper feeding mechanism feeds the paper through the first, second and third conveyance paths. A paper storage space temporarily stores the paper to prevent removal of the paper from the discharge port prior to completion of a paper cutting operation or a paper printing operation.

9 Claims, 7 Drawing Sheets

PAPER DISCHARGE DEVICE

BACKGROUND OF THE INVENTION

1. Field of the Invention

The present invention relates to a paper discharge device for conveying paper from an input side to a discharge port and, more specifically, to a paper discharge device for use in a conveyance device of a printer for conveying paper, such as a receipt or a ticket, after a printing operation.

2. Description of the Related Art

A paper discharge device for conveying paper to a discharge port to discharge the paper is provided in a thermal printer of a cash register, a ticket issuing machine for printing and then issuing a ticket, or the like.

In a cash register, a ticket issuing machine, or the like, when a leading end of paper protrudes from the discharge port when the paper is discharged, there is a fear that a situation may occur where the paper is pulled or sandwiched to be held outside the machine before the paper is completely discharged.

If the paper is pulled or held before the paper is completely discharged, unnecessary tension or stress is applied from the paper discharge device to the paper in a printing device or a paper cutting device at the previous stage to cause inconvenience such as degradation of the printing quality and irregular cut portions. Further, since stress is applied to the paper, jamming may be caused in the printing device or the paper cutting device.

In order to prevent such inconvenience, conventionally, a paper discharge device is devised which is adapted to stock paper until a printing process and a cutting process are completed and to discharge the paper after the printing process and the cutting process are completed, such as a paper conveyance device 160 disclosed in Japanese Patent No. 2721112 shown in FIG. 7.

In the paper conveyance device 160, a stock space 164 for stocking paper is provided between an input port 165 which is provided on an input side of the paper where the paper is input and conveyance rollers 161 and 162 for conveying the paper. After the leading end of the paper 60 fed from the input port 165 is sandwiched between the conveyance rollers 161 and 162, the conveyance rollers 161 and 162 are stopped while the paper 60 is continued to be conveyed from devices at the previous stage (a printing device 171 and a cutting device 172). This allows the paper 60 to be temporarily bent in the stock space 164. After the printing process and the cutting process are completed, the conveyance rollers 161 and 162 are driven to discharge the paper from a discharge port 166.

However, in the paper conveyance device according to the above patent, as mentioned in the patent itself, it is not so easy to successfully bend the paper 60 in the device. For example, the paper 60 is not successfully bent unless the angle formed between the conveyance rollers 161 and 162 and a conveyance path of the paper 60 is appropriate. Further, in order to bend the paper 60, it is necessary to, after the conveyance rollers 161 and 162 sandwich the paper 60, rotate the conveyance rollers 161 and 162 in the reverse direction by a very small amount to apply stress to the paper 60. The paper 60 can not be bent successfully without the reverse rotation.

In a paper discharge device structured to stock paper by bending the paper, if the paper can not be bent successfully, various kinds of inconvenience are caused such as a longitudinal wrinkle or fold due to unnatural stress acting on the paper and jamming due to unnatural stress traveling to the paper in the printing device or the cutting device.

Further, a paper discharge device structured to stock paper by bending the paper also has a problem in that it has low adaptability to the kind of the paper and can not accommodate, for example, thick paper, sturdy paper, and plastic paper.

As another paper discharge device adapted to stock paper in the device until the printing process and the cutting process of paper are completed, a paper discharge device adapted to stack paper in a paper conveyance path from a cutting device to a discharge port which is lengthened by detouring or the like is devised. Such a device has, however, a problem in that, since the length of paper which can be stocked is the same as the length of the conveyance path, it is constant, and, in case paper the length of which is longer is fed, the leading end of the paper protrudes before the process by the devices at the previous stage is completed.

Further, Japanese Patent No. 2893663 discloses a conveyance direction changeover device for a sheet-like article for reversing the direction of feeding the sheet-like article on the way in a conveyance path. In this conveyance direction changeover device, a pair of conveyance rollers are provided ahead of an input path. A second conveyance path is provided on the opposite side of the input path with the pair of the conveyance rollers sandwiched therebetween, while a first conveyance path is provided on the side of the input path so as to be a branch from the input path. A sheet-like article fed from the input path is once fed to the second conveyance path by the pair of the conveyance rollers. When the trailing end of the sheet-like article reaches the position of the pair of the conveyance rollers and while the trailing end of the sheet-like article is still sandwiched between the pair of the conveyance rollers, the direction of feeding the sheet-like article is reversed to make the sheet-like article go to the side of the first conveyance path branching from the input path. In this way, the direction of conveyance of the sheet-like article is reversed.

However, the above conveyance direction changeover device is not a device for discharging paper or the like to the exterior but a device for changing over the direction of conveyance of the sheet-like article in the process of performing various kinds of processing in the device, and thus, does not fall within the scope of the present invention.

Further, for the purpose of changing the direction of a sheet-like article from the side of the input path to the side of the first conveyance path, the above conveyance direction changeover device adopts the following structure. While the input path is provided such that the sheet-like article goes to a direction diagonal with respect to the pair of the conveyance rollers (to a direction tilted from a perpendicular to a line connecting central points of the pair of the conveyance rollers), the first conveyance path is provided such that the sheet-like article goes straight from the pair of the conveyance rollers (to a perpendicular direction to the line connecting the central points of the pair of the conveyance rollers).

However, though the above structure can accommodate sturdy and straight paper without a problem, in case paper having peculiarities or paper which is not sturdy is used, there is a fear that the paper sandwiched between the pair of the conveyance rollers may not extend straight and may be deflected due to the peculiarities or unsturdiness, and the paper does not go successfully to the side of the first conveyance path.

SUMMARY OF THE INVENTION

An object of the present invention is to provide a paper discharge device which can temporarily stock paper without wrinkling or folding the paper until processing such as printing or cutting at the previous stage is completed and discharge the paper from a discharge port after the processing is completed, without a limitation on the kind and length of paper used.

In order to attain the above object, according to the present invention, a paper discharge device has a driving roller, a driven roller in contact with and following the driving roller, and rotational drive means for rotating the driving roller, the paper being sandwiched between the driving roller and the driven roller and conveyed from an input side to a discharge port. The paper discharge device has a first conveyance path for guiding the paper from the input side to between the driving roller and the driven roller, a second conveyance path having an initiating end joined to the first conveyance path at a point nearer to the input side than a point where the driving roller and the driven roller come in contact and a terminating end connected to the discharge port, a paper stock space provided on a side opposite to the input side with the contact point of the driving roller and the driven roller being sandwiched therebetween a third conveyance path for guiding the paper from the contact point of the driving roller and the driven roller to the paper stock space, and control means for controlling the rotational drive means such that the paper inputted from the input side along the first conveyance path is conveyed by the driving roller and the driven roller to a side of the paper stock space and, after a trailing end of the paper passes the joining point of the first conveyance path and the second conveyance path, the paper feed direction by the driving roller is reversed to feed the paper along the second conveyance path to the discharge port.

Such means makes it possible to feed the paper inputted from the input side to a forward direction by the driving roller to guide the paper to the paper stock space, and, after the trailing end of the paper passes the joining point of the first conveyance path and the second conveyance path, the paper feed direction by the driving roller is reversed to guide the trailing end of the paper to the second conveyance path and then feed the paper to the discharge port.

In such a conveyance method, since the paper can be stocked in the paper stock space, the paper is not discharged from the discharge port until the processing by devices at the previous stage (such as printing or cutting) is completed, and can be discharged from the discharge port to the external after the processing by the devices at the previous stage is completed.

Further, since the method of stocking the paper is just feeding the paper in the forward direction and allowing the paper to droop due to its own weight in the paper stock space, no difficult control is necessary to stock the paper. Further, since no particular stress or tension is necessary to be applied to the paper, there is no fear that the paper is wrinkled or folded, and various kinds of paper such as thick paper, sturdy paper, and plastic paper, and various paper lengths can be accommodated.

Here, the above series of conveyance control can be performed by a controller for controlling the whole apparatus such as a printer, or alternatively, a dedicated controller for the paper discharge device may be provided to perform the control.

Preferably, guide means is provided at the joining point of the first conveyance path and the second conveyance path for preventing the paper fed in the reverse direction from flowing in the first conveyance path and for guiding the paper to the side of the second conveyance path.

Such guide means can prevent a mistake that, for example, when the paper is fed in the reverse direction, the trailing end of the paper goes not to the side of the second conveyance path but to the side of the first conveyance path, even if the paper has strong peculiarities or the paper is not sturdy.

More specifically, by providing the guide means of a cantilevered resilient guide piece (for example, a thin plastic piece), an end thereof being in contact with either the driving roller or the driven roller, when the paper is fed along the first conveyance path to between the driving roller and the driven roller, the guide piece can be deformed to allow the paper to pass while, when the paper is fed through the joining point of the first conveyance path and the second conveyance path in the reverse direction, the guide piece can shut out access to the side of the first conveyance path and can guide the paper to the side of the second conveyance path.

More preferably, first detection means for detecting whether there is the paper or not is provided near the joining point of the first conveyance path and the second conveyance path, and the control means changes over the operation of the rotational drive means based on the result of detection of the first detection means.

Such a structure makes it possible to recognize with accuracy that the trailing end of the paper has passed the joining point of the first conveyance path and the second conveyance path and the paper feed direction can now be reversed. Therefore, a mistake can be prevented from happening that, for example, when the trailing end of the paper is guided to the side of the second conveyance path, the trailing end of the paper is still on the side of the first conveyance path and can not be successfully guided to the side of the second conveyance path.

Further, preferably, second detection means for detecting whether there is the paper or not is provided near the contact point of the driving roller and the driven roller, and the control means changes over the operation of the rotational drive means based on the result of detection of the first detection means and the second detection means.

After the trailing end of the paper passes the contact point of the driving roller and the driven roller, since the paper leaves the conveyance mechanism, the paper can not be conveyed in the reverse direction by rotating the driving roller and the driven roller in the reverse direction. Therefore, the timing when the paper is fed in the reverse direction in order to guide the paper to the second conveyance path has to be timing after the trailing end of the paper passes the joining point of the first conveyance path and the second conveyance path and when the paper remains between the driving roller and the driven roller. The above means makes it possible to recognize with accuracy the state where the paper remains between the driving roller and the driven roller by the detection by the second detection means.

Further, a collection space for stocking the paper after a trailing end thereof passes between the rollers is provided ahead of the third conveyance path, and the control means controls the rotational drive means based on a preset condition and conveys the paper left in the second conveyance path through the third conveyance path and the paper stock space to the collection space.

Such a structure makes it possible that, in case discharged paper is not taken out and remains in a protruding state from the discharge port and predetermined time elapses, the paper is drawn from the discharge port back to the inside of the device to be collected in the collection space.

Further, preferably, the paper stock space is formed to allow the leading end of the paper conveyed by the driving roller and the driven roller to droop due to its own weight. By this, the paper can be stocked naturally.

DETAILED DESCRIPTION OF THE PREFERRED EMBODIMENTS

A preferred embodiment of the present invention is described in the following with reference to FIGS. 1–6.

Figure 1:
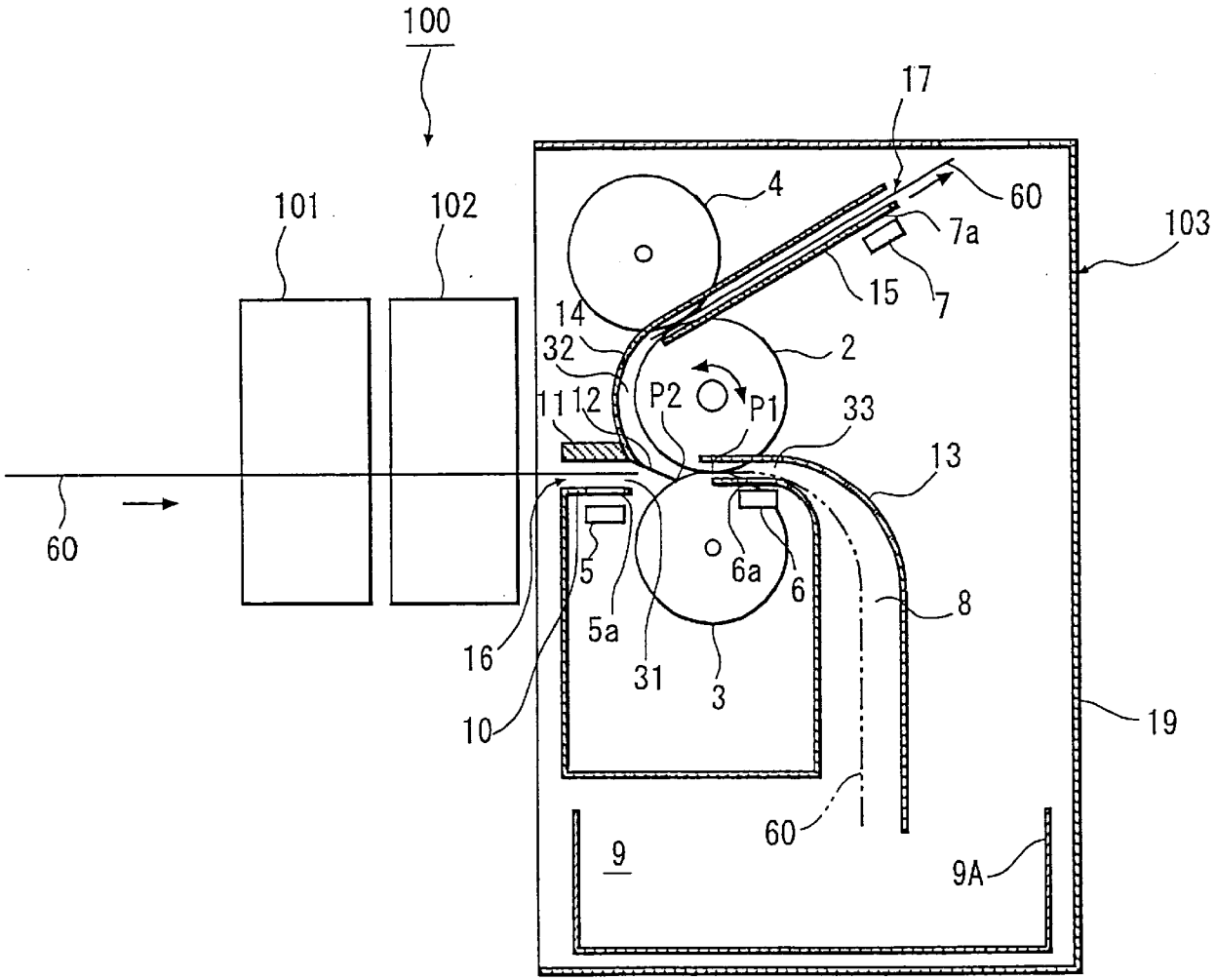
FIG. 1 is a detailed longitudinal section of a paper discharge mechanism and a schematic structure of a printer provided with the paper discharge mechanism as an embodiment of the present invention.
Figure 2:
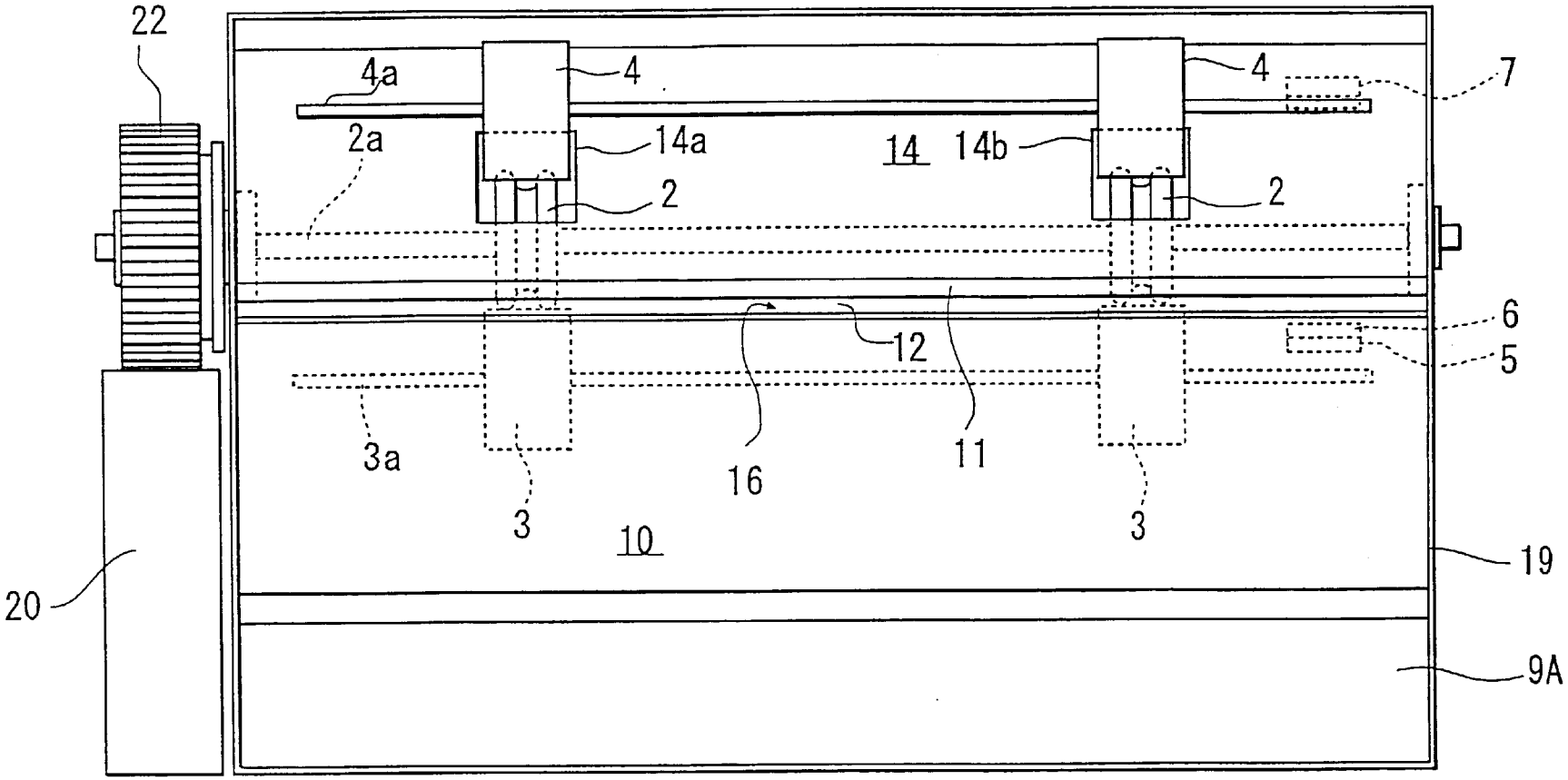
FIG. 2 is a front view showing the paper discharge mechanism of the embodiment.

FIG. 1 shows a printer provided with a paper discharge mechanism 103 as an embodiment of a paper discharge device according to the present invention, and shows a detailed longitudinal section of the paper discharge mechanism 103 and the schematic structure of a printer. FIG. 2 is a front view of the paper discharge mechanism according to this embodiment.

A printer 100 of this embodiment is provided in a ticket issuing machine, and is a printer for printing on a continuous form such as roll paper and, after the printing is completed, automatically cutting the paper and discharging the paper. The printer 100 is formed of a printing mechanism 101 provided with a print head such as a thermal head for printing lines one by one and a paper feed mechanism for intermittently feeding paper 60 while the printing is performed, a cutting mechanism 102 for cutting the paper 60 passing through the device by, for example, sandwiching the paper 60 with a V-shaped movable or fixed blade, the paper discharge mechanism 103 according to the present invention, and a controller 120 (see FIG. 3) as control means for collectively controlling the printing mechanism 101, the cutting mechanism 102, and the paper discharge mechanism 103, and the like.

As shown in FIGS. 1 and 2, the paper discharge mechanism 103 of this embodiment is formed of a driving roller 2 which can be rotationally driven both in a forward direction and in a reverse direction, two driven rollers 3 and 4 below and above the driving roller 2, respectively, in contact with the driving roller 2, first and second sensors 5 and 6 as a first detection means and a second detection means, respectively, provided along a conveyance path for detecting whether there is the paper 60 or not, a third sensor 7 provided near a discharge port 17, a paper stock space 8 for temporarily stocking the paper 60, a collection space 9 partitioned by a paper collection tray 9A for collecting the paper 60, paper guides 10, 11, and 13–15 for regulating the conveyance path of the paper 60, a guide piece 12 as guide means, a conveyance motor 20 as rotational drive means connected through a gear 22 to the driving roller 2 for rotationally driving the driving roller 2, and the like.

In the paper discharge mechanism 103 of this embodiment, the conveyance path of the paper 60 can be divided into three: a first conveyance path 31 from an input port 16 provided on the input side of the paper to a contact point P1 as a point where the driving roller 2 and the driven roller 3 come in contact; a second conveyance path 32 which is joined to the first conveyance path 31 at a joining point P2 and which is from the joining point P2 to the discharge port 17; and a third conveyance path 33 from the contact point P1 of the driving roller 2 and the driven roller 3 to the paper stock space 8 on the downstream side (on the side opposite to the input port 16).

Among them, the first conveyance path 31 is, though, in a state without the paper, shut out on the way by the guide piece 12, provided from the contact point P1 of the driving roller 2 and the driven roller 3 in a perpendicular direction to the line connecting the central points of the rollers 2 and 3 (that is, in a direction where the paper sandwiched between the rollers 2 and 3 extends straight). The initiating end portion of the second conveyance path 32 is provided in a direction slightly tilted from a perpendicular to the line connecting the central points of the rollers 2 and 3. The third conveyance path 33 is provided in a perpendicular direction to the line connecting the central points of the rollers 2 and 3 at a point near the driving roller 2 and the driven roller 3.

As shown in FIG. 2, the driving roller 2 and the driven rollers 3 and 4 are plural in number (two, for example), respectively, are spaced apart on rotational axes 2*a*, 3*a*, and 4*a* laid horizontally in a freely rotatable state, respectively, and are rotatably supported about the rotational axes 2*a*, 3*a*, and 4*a*, respectively. Among the rollers 2, 3, and 4, the driving roller 2 and the driven roller 3 are the main paper conveyance means. By the rollers 2 and 3, a paper is fed such that the paper 60 is conveyed from the first conveyance path 31 to the third conveyance path 33, from the third conveyance path 33 to the second conveyance path 32, and from the second conveyance path 32 to the third conveyance path 33. The driven roller 4 is an auxiliary roller for, when the paper 60 is fed to the second conveyance path 32, conveying the paper 60 to the discharge port.

Further, in FIG. 2, the paper guides 10, 11, and 13–15 and the guide piece 12 are provided across the whole width of a frame 19. The paper guides 10, 11, and 13–15 are formed of metal or plastic and are not deformed. In addition, the paper guides 10, and 13–15 have openings provided therein openings 14*a* and 14*b* in regions where they overlap the driving roller 2 and the driven rollers 3 and 4 so as to avoid interference with the rollers 2–4, though the openings in the paper guides 10, 13, and 15 are omitted in the figure.

The paper guide 13 is bent so as to form the downwardly bent space 8 which allows the paper 60 which has passed between the rollers 2 and 3 to droop due to its own weight. This makes it possible to, when sturdy paper is used, compulsorily bend the paper. Even if the paper is bent, since it is sturdy in itself, no wrinkle is formed.

The guide piece 12 as the guide means is formed of a sheet-like material that is flexible or elastic. The guide piece 12 is attached such that one end of it is fixed while the other end of it is in contact with the outer peripheral surface of the roller 3. When the paper 60 passes, the guide piece 12 is deformed a little by the thickness of the paper 60. When there is no paper, the guide piece 12 returns to its original form by its elasticity. The guide piece 12 plays a role to separate the first and the second conveyance paths 31 and 32 from each other at the joining point P2 of the first conveyance path 31 and the second conveyance path 32. In a state where the paper 60 is not passing, by closing the space between the guide piece 12 and the driven roller 3 as shown in FIG. 1, the guide piece 12 acts, when the paper 60 is fed in the reverse direction after the trailing end of the paper 60 passes the joining point P2, such that the trailing end of the paper 60 is guided not to the side of the first conveyance path 31 but to the side of the second conveyance path 32.

The sensors 5–7 are, for example, reflection type photosensors, and are attached so as to face open windows 5*a*–7*a* provided at corresponding positions of the paper guides 10 and 15, respectively. It is to be noted that, as the sensors, transmission type photosensors or mechanical sensors such as proximity switches may also be used. Among them, the first sensor 5 as the first detection means is provided near the joining point P2 of the first conveyance path 31 and the second conveyance path 32 and on the upstream side (on the side of the input port 16) of the joining point P2 along the first conveyance path 31, such that it can be detected that the trailing end of the paper 60 has passed the joining point P2.

The second sensor 6 as the second detection means is provided near the contact point P1 of the driving roller 2 and the driven roller 3 and on the downstream side of the contact point P1, such that it can be detected whether the paper 60 is still sandwiched between the driving roller 2 and the driven roller 3 or not.

The third sensor 7 detects a state where the paper 60 is not taken out from the discharge port 17 and is left at the discharge port 17.

It is to be noted that a position where a sensor is attached is "near" something as used herein means that the sensor is near something when seen from the side. With regard to the width direction of the paper 60, the position of the sensor may be anywhere, i.e., to the left, to the right, at the center, and so on.

The paper stock space 8 is a three-dimensional space and is formed so as to fan out to the downward direction to allow the leading end of the paper fed to the third conveyance path 33 by the driving roller 2 and the driven roller 3 to droop due to its own weight. Thus, the paper 60 can be stocked in a naturally tensioned state without a wrinkle. Further, the collection space 9 vastly spreading both in length and breadth is provided below the paper stock space 8. Even in case the printed length is long and the paper 60 is longer than the paper stock space 8, the collection space 9 can also serve as an auxiliary space of the paper stock space 8 to stock the paper 60.

Figure 3:
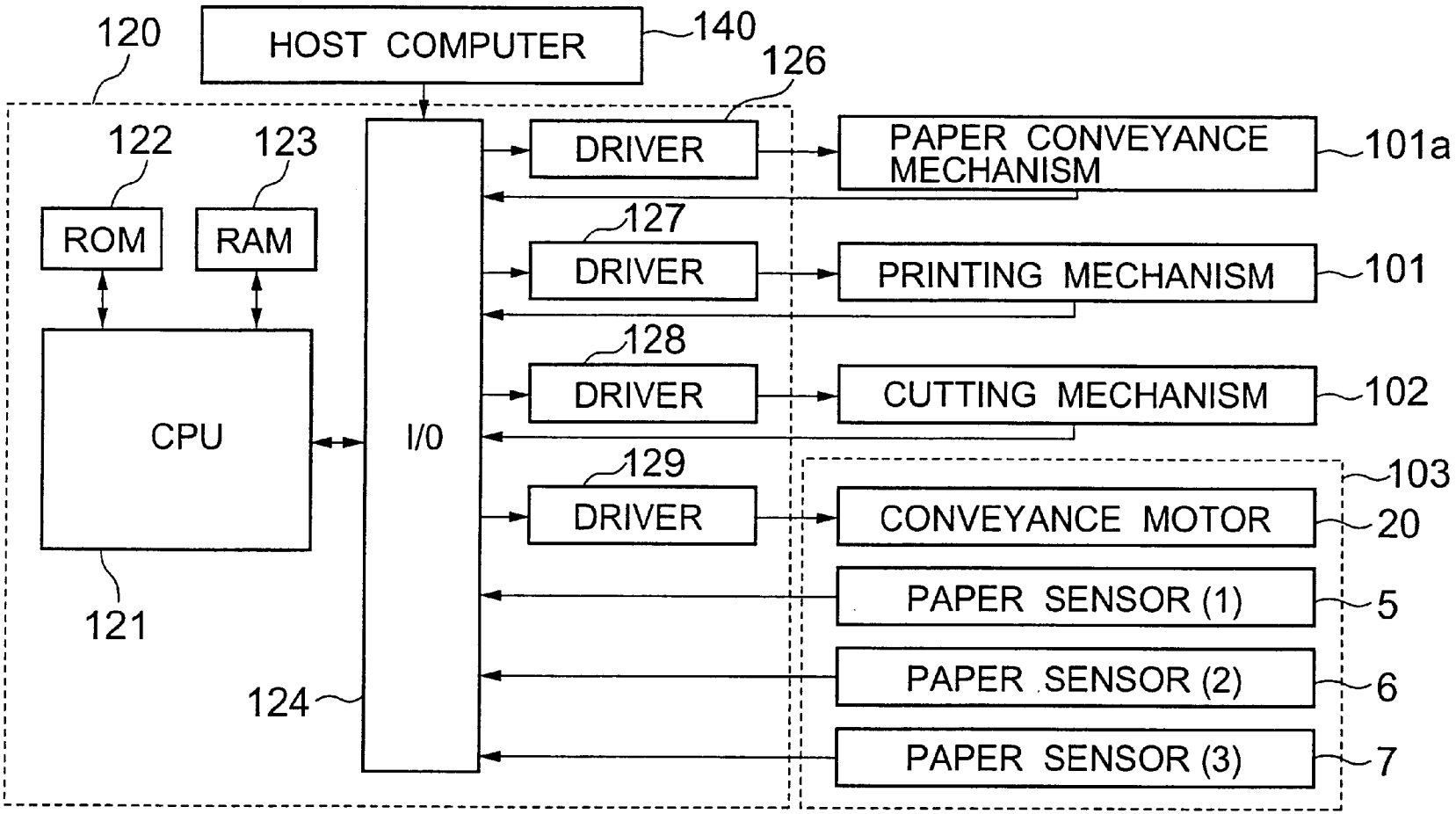
FIG. 3 is a block diagram showing the structure of a circuit of the printer using the paper discharge mechanism of the embodiment.

FIG. 3 is a block diagram showing the structure of a circuit of a control system of the printer 100 according to the embodiment.

As shown in the figure, the controller 120 is formed of a CPU 121 for controlling the whole printer 100, a ROM 122 where various kinds of control programs executed by the CPU 121 and control data are stored, a RAM 123 for providing a storage area for temporarily storing printing data sent from a host computer 140 and a working area for the CPU 121, an I/O interface 124 for signal input/output among the host computer 140, the printing mechanism 101, the paper conveyance mechanism 101*a* provided in the printing mechanism 101, the cutting mechanism 102, and the paper discharge mechanism 103, driver circuits 126–129 for driving various kinds of actuators provided in the printing mechanism 101, the paper conveyance mechanism 101*a* provided in the printing mechanism 101, the cutting mechanism 102, and the paper discharge mechanism 103 (for example, a conveyance motor of the paper conveyance mechanism 101*a*, the print head of the printing mechanism 101, a motor for driving a cutting blade of the cutting mechanism 102, and the conveyance motor 20 of the paper discharge mechanism 103), and the like.

The first to third sensors 5–7 of the paper discharge mechanism 103 are connected to the I/O interface 124 such that a detection signal indicating on/off of the sensors is inputted o the CPU 121.

In the printer 100 of this embodiment, the controller 120 of the printer 100 collectively controls the printing mechanism 101, the cutting mechanism 102, and the paper discharge mechanism 103. Further, printing data is sent from the host computer 140 of the ticket issuing machine to the controller 120. Based on the printing data, the printing mechanism 101, the cutting mechanism 102, and the paper discharge mechanism 103 are controlled to perform a series of printer processing from printing through cutting of the paper 60 to discharge of the paper 60.

Next, operation of the paper discharge mechanism 103 structured as above is briefly described.

In the paper discharge mechanism 103 of this embodiment, first, when the paper 60 fed from mechanisms at the previous stages such as the printing mechanism 101 and the cutting mechanism 102 approaches between the driving roller 2 and the driven roller 3, the first sensor detects it to activate the conveyance motor 20 to rotationally drive the driving roller 2 counterclockwise in FIG. 1. Then, the paper 60 continues to be fed, and the paper 60 is sandwiched between the driving roller 2 and the driven roller 3. As the driving roller 2 rotates, the paper is conveyed from the first conveyance path 31 to the third conveyance path 33.

Then, just before the trailing end of the paper 60 cut by the cutting mechanism 102 comes between the driving roller 2 and the driven roller 3, the first sensor 5 detects the trailing end of the paper. The controller 120 stops the counterclockwise rotation of the driving roller 2 at predetermined timing from the detection. Here, the predetermined timing is timing when the trailing end of the paper 60 is between the joining point P2 of the first conveyance path 31 and the second conveyance path 32 and the contact point P1 of the driving roller 2 and the driven roller 3. Here, though the trailing end of the paper 60 has passed between the flexible guide piece 12 and the driven roller 3 to come in the second conveyance path 32, the trailing end of the paper 60 has not passed yet between the driving roller 2 and the driven roller 3.

It is to be noted that, in this embodiment, since the distance between the joining point P2 and the contact point P1 is structured to be relatively short, the above timing is decided based on the detection by the first sensor 5. However, in case the distance between the joining point P2 and the contact point P1 is structured to be long, another sensor may be provided at the midpoint between the joining point P2 and the contact point P1, or, on the upstream side of and near the contact point P1, and the above timing may be decided based on the detection by this sensor.

When the counterclockwise rotation of the driving roller 2 is stopped at the above timing, then, the conveyance motor 20 rotates in the reverse direction to rotate the driving roller 2 clockwise. This changes the course of the paper 60 toward the second conveyance path 32 with the trailing end being in contact with the guide piece 12, and the paper 60 is fed to the discharge port 17. Then, the conveyance motor 20 is stopped with one end of the paper 60 protruding from the discharge port 17.

Then, in case the paper 60 is not taken out to the external and remains at the discharge port 17, the driving roller 2 is rotationally driven counterclockwise, and the paper 60 goes in the reverse direction along the second conveyance path 32 through the second conveyance path 33 to be collected in the collection space 9. The waiting time until the collection of the paper 60 is started may be appropriately decided according to predetermined conditions based on elapsed time after the paper 60 protrudes from the discharge port 17, request for execution of the next printing processing, or the like.

The procedure performed by the printer 100 for controlling the printer from printing to discharge is now described in detail with reference to a flow chart shown in FIGS. 4–6.

Figure 4:
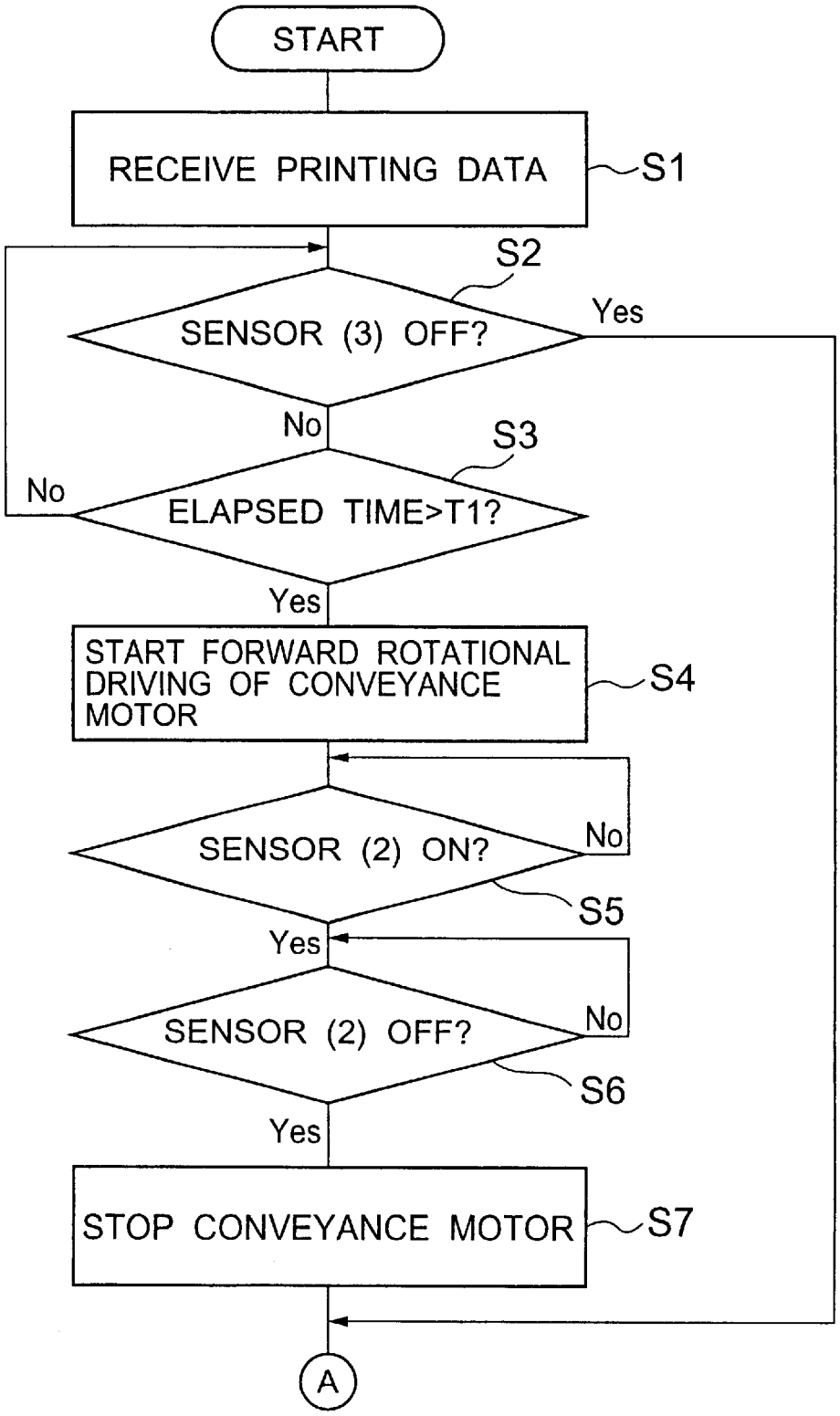
FIG. 4 is a first stage portion of a flow chart showing the procedure of printing and paper discharging processing executed by the CPU in FIG. 3.
Figure 5:
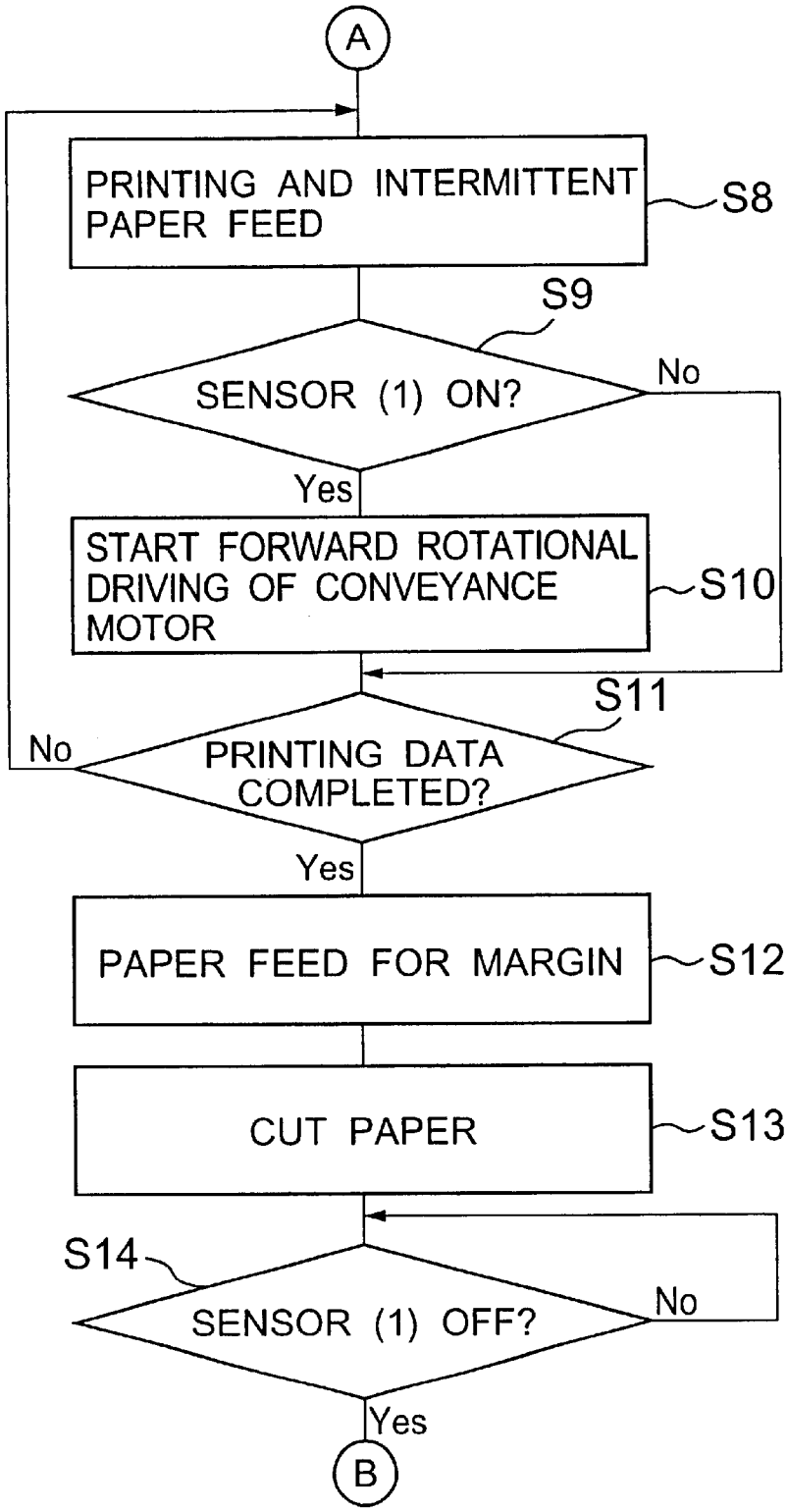
FIG. 5 is a second stage portion of the flow chart showing the procedure of printing and paper discharging processing executed by the CPU in FIG. 3.
Figure 6:
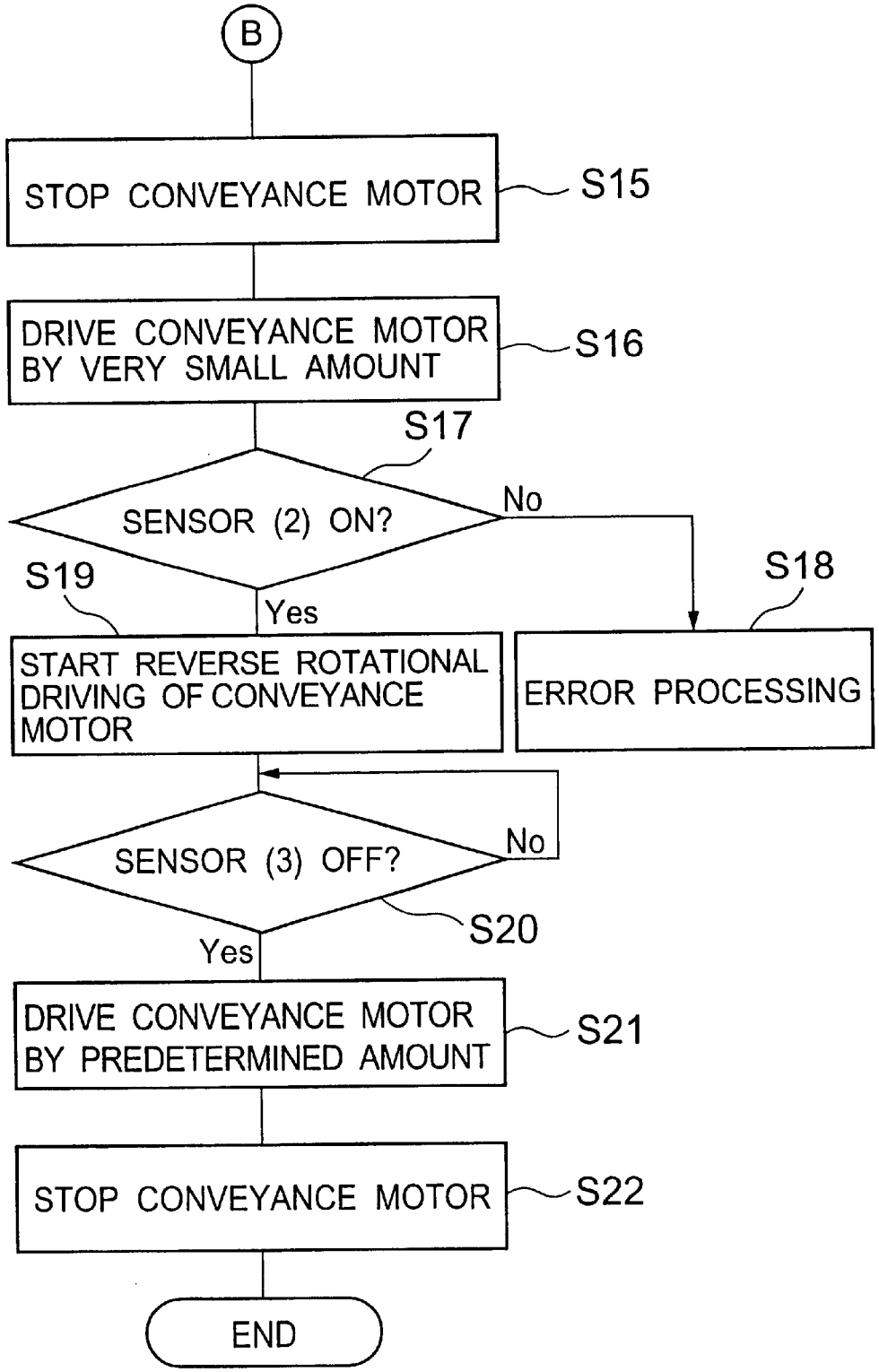
FIG. 6 is a third and the last stage portion of the flow chart showing the procedure of printing and paper discharging processing executed by the CPU in FIG. 3.
Figure 7:
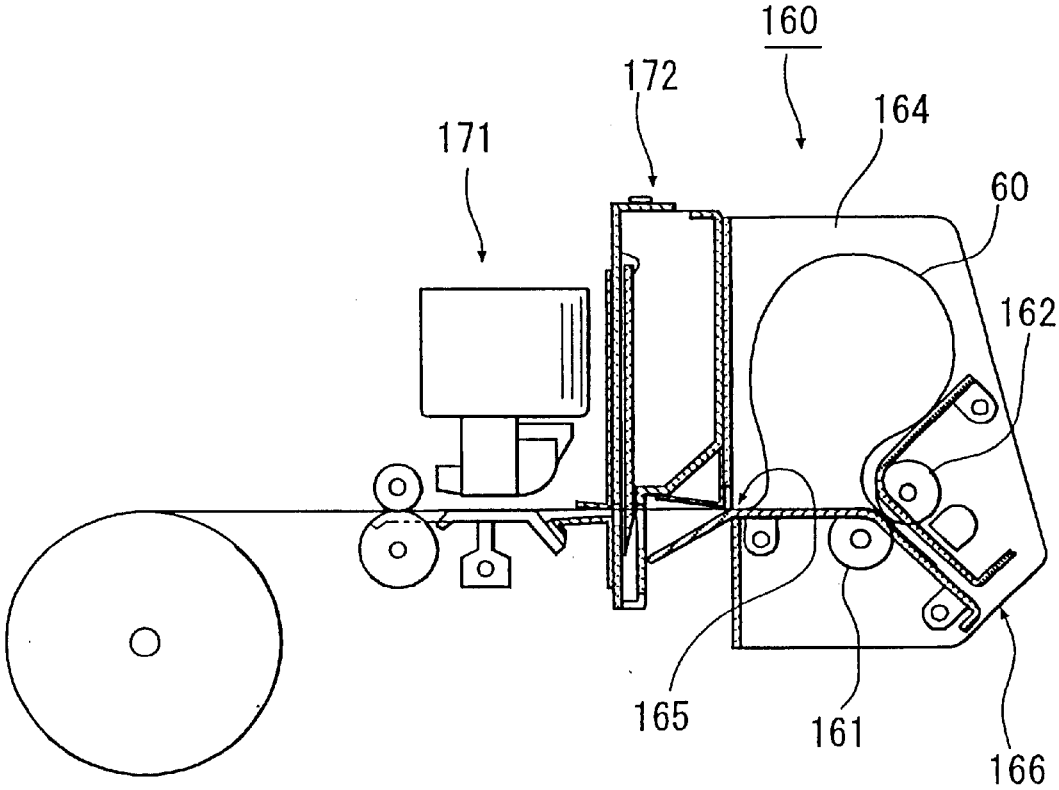
FIG.7 PRIOR ART
FIG. 7 is a longitudinal section showing an example of a conventional paper conveyance device.

FIGS. 4–6 are a flow chart showing a control program of the printer processing executed by the CPU 121.

The printer processing is started by transmitting printing data from the host computer 140 to the controller 120. When the printer processing is started, first at step S1, printing data receiving processing where the printing data is received from the host computer 140 and is stored in the RAM 123 is performed. Then, the procedure goes to step S2.

At step S2, a detection signal from the third sensor 7 of the paper discharge mechanism 103 is inputted to determine whether the sensor 7 is off or not. If it is determined that the paper 60 is not at the discharge port 17 and that the sensor 7 is off, the procedure jumps to step S8 to go to the printing processing starting at that step. If it is determined that the paper 60 is at the discharge port 17 and that the sensor 7 is on, the procedure goes to step S3.

At step S3, a set time T1 (for example, 10 seconds) preset for collecting the paper and the time elapsed after the reception of the printing data are compared. If the set time T1 has not elapsed, the procedure returns to S2 to repeat the determining processing by the sensor 7. If the set time T1 has elapsed, the procedure goes to step S4 and paper collecting processing from step S4 to step S6 is performed.

When the procedure goes to step S4, the conveyance motor 20 of the paper discharge mechanism 103 is rotationally driven in the forward direction, and the procedure goes to step S5. By this driving of the conveyance motor 20, the paper 60 left at the discharge port 17 begins to go along the second conveyance path 32 in the reverse direction.

At step S5, it is determined whether the second sensor 6 of the paper discharge mechanism 103 is in an ON state or not. If the paper 60 left at the discharge port 17 approaches between the driving roller 2 and the driven roller 3 and the sensor 6 turns on, the procedure goes to the next step S6. If the paper 60 has not yet approached between the driving roller 2 and the driven roller and the sensor 6 is in an OFF state, the processing at this step S5 is repeated until the sensor 6 turns on.

At step S6, it is determined whether the second sensor 6 is in the OFF state or not. If the paper 60 approaching between the driving roller 2 and the driven roller 3 passes between the rollers 2 and 3 and the sensor 6 turns off, the procedure goes to the next step S7. If the paper 60 still remains between the rollers 2 and 3 and the sensor 6 is in the ON state, the processing at this step S6 is repeated until the sensor 6 turns off.

When, as a result, the paper 60 left at the discharge port 17 is collected by the collection space 9 and the procedure goes to step S7, the conveyance motor 20 of the paper discharge mechanism 103 is stopped at step S7, and the procedure then goes to printing processing which starts at step S8.

At step S8, a drive signal based on the printing data is sent to the print head of the printing mechanism 101 to print unit lines one by one, while a motor for conveying the paper of the printing mechanism 101 is driven by a very small amount to feed the paper intermittently by a unit line. Then, the procedure goes to step S9.

At step S9, a detection signal from the first sensor 5 of the paper discharge mechanism 103 is inputted. If the leading end of the paper 60 has not been conveyed to a point just before the driving roller 2 of the paper discharge mechanism 103 and the sensor 5 is OFF, the procedure goes to step S11. If the leading end of the paper 60 has been conveyed to the point just before the driving roller 2 and the sensor 5 is turned on, the procedure goes to step S10.

When, as a result, the leading end of the paper 60 has been conveyed to the point just before the driving roller 2 and the procedure goes to step S10, rotation of the conveyance motor 20 of the paper discharge mechanism 103 in the forward direction is started at this step, and then, the procedure goes to step S11.

In other words, in the processing at this step S10, when the paper 60 on which printing is being performed approaches the driving roller 2 of the paper discharge mechanism 103, the driving roller 2 starts to rotate in the forward direction such that the paper 60 is conveyed to the paper stock space 8.

At step S11, it is determined whether all the printing data stored in the RAM 123 have been printed or not. If the printing has been completed, the printing processing ends and the procedure goes to the next step S12. If the printing has not been completed, the printing processing starting at step S8 is repeated until the printing is completed.

When the printing processing ends and the procedure goes to step S12, at this step, in order to leave a margin from a printing end line to a cutting line, the motor for conveying the paper of the printing mechanism 101 is rotationally driven by a predetermined amount and is then stopped. Next, at step S13, a motor for driving the cutting blade of the cutting mechanism 102 is driven to cut the paper 60. Then, the procedure goes to step S14.

At this timing when the procedure goes from step S13 to step S14, since, at step S10, the conveyance motor 20 of the paper discharge mechanism 103 is rotationally driven in the forward direction, the paper 60 is being conveyed from the first conveyance path 31 to the third conveyance path 33 of the paper discharge mechanism 103.

At step S14, a detection signal from the first sensor 5 of the paper discharge mechanism 103 is inputted. If the trailing end of the paper 60 has passed the joining point P2 of the first conveyance path 31 and the second conveyance path 32 and the sensor 5 is turned off, the procedure goes to step S15. If the trailing end of the paper 60 has not yet passed the joining point P2 and the sensor 5 is in the ON state, this step is repeated until the sensor is turned off.

When, as a result, the trailing end of the paper 60 has passed the joining point P2 and the procedure goes to step S15, the conveyance motor 20 is stopped for a time at this step. Then, at step S16, the conveyance motor 20 is rotated in the forward direction by a preset very small amount, and the procedure goes to step S17. The driving processing at step S16 is for the purpose of making the trailing end of the paper 60 pass the joining point P2 without fail. The amount of driving the conveyance motor 20 is set such that, taking into consideration the arrangement of the first sensor 5, the position of the joining point P2, and the distance from the joining point P2 to the contact point P1 of the driving roller 2 and the driven roller 3, the trailing end of the paper 60 passes the joining point P2 without fail, and the trailing end of the paper 60 remains on the side before the contact point P1 of the driving roller 2 and the driven roller 3 to prevent the paper 60 from falling in the collection space 9.

By the processing at this step S16, the trailing end of the paper 60 passes between the driven roller 3 and the guide piece 12 to move to the side of the second conveyance path 32.

At step S17, a detection signal is inputted from the second sensor 6 provided near the contact point P1 of the driving roller 2 and the driven roller 3 to confirm that the paper 60 is sandwiched between the driving roller 2 and the driven roller 3 without falling in the collection space 9. If the paper 60 has fallen and the sensor 6 is OFF, the procedure goes to step S18 to perform error processing. If the paper 60 remains and the sensor 6 is ON, the procedure goes to step S19.

At step S19, driving of the conveyance motor 20 in the reverse direction is started, and the procedure goes to step S20. By the driving of the conveyance motor 20 at this step S19, the paper 60 stocked in the paper stock space 8 with its trailing end portion being sandwiched between the driving roller 2 and the driven roller 3 is conveyed along the second conveyance path 32 to the side of the discharge port 17.

At step S20, a detection signal by the third sensor 7 is monitored to determine whether the paper 60 has reached the discharge port 17 or not. If the paper 60 has not reached the discharge port 17 and the third sensor 7 is OFF, this step is repeated until the third sensor 7 is turned on. If the paper 60 has reached the discharge port 17 and the third sensor 7 turns on, the procedure goes to step S21.

At step S21, the conveyance motor 20 is driven by just a rotational amount preset such that the leading end of the paper 60 protrudes from the discharge port 17 by a predetermined amount. Then, at the next step S22, the conveyance motor 20 is stopped, the printer processing is ended, and the device waits until the next printing data is inputted from the host computer 140.

As described in the above, according to the printer 100 and the paper discharge mechanism 103 of this embodiment, since the paper 60 after being printed can be stocked for a time in the paper stock space 8, the end of the paper is not discharged from the discharge port 17 until the processing by the mechanisms at the previous stage (such as printing or cutting processing) is completed, and the paper 60 can be discharged from the discharge port 17 to the external after the processing by the mechanisms at the previous stage is completed. Therefore, a situation where the paper 60 is pulled from the external before the internal processing is completed can be prevented.

Further, since the method of stocking the paper 60 is just feeding the paper 60 in the forward direction and allowing the paper 60 to droop due to its own weight, no difficult control is necessary to stock the paper 60 compared with the case of the cited patent which stocks the paper 60 by bending it. Further, since no particular stress or tension is applied to the paper 60, there is no fear that the paper 60 is wrinkled or folded, and various kinds of paper such as thick paper, sturdy paper, and plastic paper, and various paper lengths can be accommodated.

Further, since the first sensor 5 is provided near the joining point P2 of the first conveyance path 31 and the second conveyance path 32, it possible to recognize with accuracy that, from the sensor output of the first sensor 5, the trailing end of the paper 60 has passed the joining point of the first conveyance path 31 and the second conveyance path 32 and the paper feed direction of the paper 60 can now be reversed. Therefore, a mistake can be prevented from happening that, for example, when, for the purpose of discharging the paper 60 from the discharge port 17, the driving roller 2 is rotated in the reverse direction and the trailing end of the paper 60 is guided to the side of the second conveyance path 32, the trailing end of the paper 60 is still on the side of the first conveyance path 31 and can not be successfully guided to the side of the second conveyance path 32.

Further, when, for the purpose of discharging the paper 60 from the discharge port 17, the driving roller 2 is rotated in the reverse direction and the trailing end of the paper 60 is guided to the side of the second conveyance path 32, if the trailing end of the paper 60 has passed between the driving roller 2 and the driven roller 3, the paper 60 has passed between the rollers 2 and 3, and it is not possible to change the feed direction of the paper 60 to discharge the paper 60 from the discharge port 17. However, since the second sensor 6 is provided near the contact point P1 of the driving roller 2 and the driven roller 3, it possible to detect that, from the sensor output of the sensor 6, the paper 60 has passed between the driving roller 2 and the driven roller 3. Therefore, it is possible to, for example, give the printing mechanism 101 a command to perform reprinting, or to give timing when the motor is to be stopped when the paper which has not been discharged is collected.

Still further, the guide piece 12 provided between the first conveyance path 31 and the second conveyance path 32 can prevent from happening a mistake that, for example, when the paper 60 is fed in the reverse direction, the trailing end of the paper 60 goes not to the side of the second conveyance path 32 but to the side of the first conveyance path 31.

Further, since the collection space 9 for collecting the paper 60 is provided on the downstream side of the paper stock space to, in case, for example, discharged paper remains at the discharge port 17 and predetermined time has elapsed, or, jamming, a mistake in cutting, poor printing, or the like is detected from a signal from a sensor, collect the paper 60 in the collection space 9 based on predetermined conditions, inconveniences such as jamming caused because the next piece of paper is discharged with the paper 60 remaining at the discharge port 17 can be avoided.

Although the present invention is specifically described in the above based on the embodiment, it goes without saying that the present invention is not limited to the above embodiment, and various modifications may be made without departing from the spirit of the present invention.

For example, as the conveyance mechanism, a structure where the driving roller and the driven roller sandwich the paper to feed the paper is described, but a structure in the form of a conveyor belt may also be used. Further, though the conveyance path of the paper is formed using the paper guides as partitions, but in case the paper path is determined without regulating the paper, such paper guides may not be provided. Still further, the guide means provided at the joining point of the first conveyance path 31 and the second conveyance path 32 is not limited to the guide piece 12 of a flexible type as described in the embodiment, and may be, for example, structured to have a rigid changeover valve rotated by a cum which in turn is rotated by a motor to switch over the feed path such that the trailing end of the paper fed in the reverse direction does not go to the side of the first conveyance path 31. Still further, the structure may be such that, by providing a paper guide in an appropriate arrangement or utilizing the curled state of the paper without no particular guide means provided, the trailing end of the paper fed in the reverse direction does not go to the side of the first conveyance path.

Still further, the first to third conveyance paths are not limited to the first conveyance path 31, the second conveyance path 32, and the third conveyance path 33 of the embodiment shown in FIG. 1. For example, the joining point of the first conveyance path and the second conveyance path is not required to be near the point where the driving roller and the driven roller come in contact, and may be further on the upstream side. Similarly, the first conveyance path, the second conveyance path, and the third conveyance path are not required to cross at substantially one point. As long as the end portions of the respective conveyance paths trifurcate, the conveyance paths are not required to cross at one point. The angles formed by the respective paths and the curves of the respective paths may be appropriately modified without departing from the spirit of the present invention.

Though, in the above description, the present invention is described with regard to a paper discharge mechanism of a printer as a field of the present invention, the present invention is not limited thereto, and may be widely applied to paper discharge devices which conveys paper such as printing paper to a discharge port.

As described the above, according to the present invention, paper can be temporarily stocked in the device before being discharged from the discharge port. Further, there is no fear that the paper is wrinkled or folded, and various kinds of paper such as thick paper, sturdy paper, and plastic paper, and various paper lengths can be accommodated.

In addition, there is an effect that, by the first and second sensors provided near the joining point of the first conveyance path and the second conveyance path and near the contact point of the driving roller and the driven roller, when the paper feed direction is changed over, the timing when the rotational drive means is rotated in the reverse direction to guide the trailing end of the paper to the side of the second conveyance path can be successfully recognized.

In addition, there is an effect that, by the guide means provided at the joining point of the first conveyance path and the second conveyance path, when the paper is fed to the discharge port, the trailing end of the paper can be successfully guided to the side of the second conveyance path to feed the paper to the side of the discharge port without fail.

In addition, since the collection space for collecting the paper is provided on the downstream side of the paper stock space, and the paper left at the discharge port is collected in the collection space based on preset conditions, there is an effect that inconveniences such as jamming caused because the next piece of paper is discharged with the paper remaining at the discharge port can be avoided.

What is claimed is:

1. A paper discharge device comprising:

an input port through which paper is introduced;

a discharge port through which the paper is discharged;

a driving roller mounted for undergoing rotation;

a driven roller disposed in contact with the driving roller for rotation therewith and defining therebetween a paper clamping portion for clamping the paper;

rotational drive means for rotating the driving roller in opposite directions of rotation to feed the paper from the input port to the discharge port;

a first conveyance path for guiding the paper from the input port to the paper clamping portion between the driving roller and the driven roller;

a second conveyance path having an initiating end disposed in the first conveyance path at a point closer to the input port than the paper clamping portion between the driving roller and the driven roller, and a terminating end disposed at the discharge port;

a paper storage space for temporarily storing the paper to prevent removal of the paper from the discharge port until a paper printing operation or a paper cutting operation is completed, the paper storage space being disposed on a side of the paper discharge device opposite to a side thereof on which the input port is disposed with the paper clamping portion of the driving roller and the driven roller being disposed therebetween;

a third conveyance path for guiding the paper from the paper clamping portion between the driving roller and the driven roller to the paper storage space; and control means for controlling the rotational drive means so that when a leading end of the paper is inserted into the input port and along the first conveyance path, the paper is conveyed by the driving roller and the driven roller along the third conveyance path to guide the paper into the paper storage space, and so that after a trailing end of the paper passes the initiating end of the second conveyance path, the rotational direction of the driving roller is reversed to feed the paper along the second conveyance path to the discharge port.

2. A paper discharge device as claimed in claim 1; further comprising guide means disposed at the initiating end of the second conveyance path for preventing the paper from entering into the first conveyance path when the rotational direction of the driving roller is reversed and for guiding the paper into the second conveyance path.

3. A paper discharge device as claimed in claim 2; wherein the guide means comprises a cantilevered resilient guide piece having an end for contacting the driven roller to prevent access of the paper into the first conveyance path when the rotational direction of the driving roller is reversed and for undergoing deformation toward the driving roller when the paper is fed along the first conveyance path toward the paper clamping portion between the driving roller and the driven roller to allow the paper to be conveyed along the third conveyance path and into the paper storage space.

4. A paper discharge device as claimed in claim 1; further comprising first detection means for detecting whether or not the trailing end of the paper has passed the initiating end of the second conveyance path; and wherein the control means includes means for reversing the rotational direction of the driving roller in accordance with a detection result of the first detection means.

5. A paper discharge device as claimed in claim 4; further comprising second detection means for detecting whether or not the paper is disposed at the paper contact portion between the driving roller and the driven roller; and wherein the control means includes means for reversing the rotational direction of the driving roller in accordance with detection results of the first detection means and the second detection means.

6. A paper discharge device comprising:

an input port through which paper is introduced;

a discharge port through which the paper is discharged;

a driving roller mounted for undergoing rotation;

a driven roller disposed in contact with the driving roller for rotation therewith and defining therebetween a paper clamping portion for clamping the paper;

rotational drive means for rotating the driving roller in opposite directions of rotation to feed the paper from the input port to the discharge port;

a first conveyance path for guiding the paper from the input port to the paper clamping portion between the driving roller and the driven roller;

a second conveyance path having an initiating end disposed in the first conveyance path at a point closer to the input port than the paper clamping portion between the driving roller and the driven roller and a terminating end disposed at the discharge port;

a paper storage space for storing the paper and disposed on a side of the paper discharge device opposite to a side thereof on which the input port is disposed with the paper clamping portion of the driving roller and the driven roller being disposed therebetween;

a third conveyance path for guiding the paper from the paper clamping portion between the driving roller and the driven roller to the paper storage space;

a paper collection space for collecting the paper passing through the third conveyance path after a trailing end of the paper passes the paper clamping portion between the driving and driven rollers; and control means for controlling the rotational drive means so that when a leading end of the paper is inserted into the input port and along the first conveyance path, the paper is conveyed by the driving roller and the driven roller along the third conveyance path to guide the paper into the paper storage space, so that after a trailing end of the paper passes the initiating end of the second conveyance path, the rotational direction of the driving roller is reversed to feed the paper along the second conveyance path to the discharge port, and so that any paper remaining in the second conveyance path is conveyed through the third conveyance path and the paper storage space and into the paper collection space.

7. A paper discharge device as claimed in claim 1; wherein the third conveyance path extends through the paper storage space so that the leading end of the paper conveyed by the driving roller and the driven roller droops into the paper storage space due to the weight of the paper.

8. A paper discharge device comprising:

a first conveyance path having an input port through which paper is introduced;

a second conveyance path having a discharge port through which the paper is discharged, the second conveyance path having an initiating end disposed in the first conveyance path and a terminating end disposed at the discharge port;

a third conveyance path;

paper feeding means for feeding the paper through the first, second and third conveyance paths, the paper feeding means comprising a driving roller mounted for undergoing rotation, a driven roller disposed in contact with the driving roller for rotation therewith and defining therebetween a paper clamping portion for clamping the paper, and rotational drive means for rotating the driving roller in opposite directions of rotation to feed the paper from the input port to the discharge port;

paper storage means positioned to receive paper fed through the third conveyance path for temporarily storing the paper to prevent removal of the paper from the discharge port prior to completion of a paper cutting operation or a paper printing operation; and guide means disposed at the initiating end of the second conveyance path for preventing the paper from entering into the first conveyance path when the rotational direction of the driving roller is reversed and for guiding the paper into the second conveyance path, the guide means comprising a cantilevered resilient guide piece having an end for contacting the driven roller to prevent access of the paper into the first conveyance path when the rotational direction of the driving roller is reversed and for undergoing deformation toward the driving roller when the paper is fed along the first conveyance path toward the paper clamping portion between the driving roller and the driven roller to allow the paper to be conveyed in the third conveyance path.

9. A paper discharge device comprising:

a first conveyance path having an input port through which paper is introduced;

a second conveyance path having a discharge port through which the paper is discharged;

a third conveyance path;

paper feeding means for feeding the paper through the first, second and third conveyance path, the paper feeding means comprising a driving roller mounted for undergoing rotation, a driven roller disposed in contact with the driving roller for rotation therewith and defining therebetween a paper clamping portion for clamping the paper, and rotational drive means for rotating the driving roller in opposite directions of rotation to feed the paper from the input port to the discharge port;

paper storage means positioned to receive paper fed through the third conveyance path for temporarily storing the paper to prevent removal of the paper from the discharge port prior to completion of a paper cutting operation or a paper printing operation; and control means for controlling the rotational drive means so that when a leading end of the paper is inserted into the input port and along the first conveyance path, the paper is conveyed by the driving roller and the driven roller along the third conveyance path, and so that after a trailing end of the paper passes the initiating end of the second conveyance path, the rotational direction of the driving roller is reversed to feed the paper along the second conveyance path to the discharge port.

* * * * *